US009803920B2

(12) United States Patent
Asakura et al.

(10) Patent No.: US 9,803,920 B2
(45) Date of Patent: Oct. 31, 2017

(54) INK DRYING METHOD AND INK DRYING DEVICE

(71) Applicants: DAIDO SANGYO CO., LTD., Saitama (JP); FUJISHOUKO CO., LTD., Shizuoka (JP); NIHON DENNETSUI CO., LTD., Nagano (JP); Kentaro Asakura, Tokyo (JP)

(72) Inventors: Kentaro Asakura, Tokyo (JP); Shunsuke Hasegawa, Shizuoka (JP); Shigeyuki Takahashi, Osaka (JP); Yoshihiro Doba, Tokyo (JP); Masao Fukudome, Tokyo (JP); Kazuto Kobayashi, Nagano (JP); Toshiaki Yamaguchi, Kanagawa (JP); Yasuo Yamaguchi, Kanagawa (JP)

(73) Assignees: DAIDO SANGYO CO., LTD., Saitama (JP); FUJISHOUKO CO., LTD., Shizuoka (JP); KENTARO ASAKURA, Tokyo (JP)

( * ) Notice: Subject to any disclaimer, the term of this patent is extended or adjusted under 35 U.S.C. 154(b) by 408 days.

(21) Appl. No.: 14/376,272

(22) PCT Filed: Feb. 4, 2013

(86) PCT No.: PCT/JP2013/052517
§ 371 (c)(1),
(2) Date: Aug. 1, 2014

(87) PCT Pub. No.: WO2013/115402
PCT Pub. Date: Aug. 8, 2013

(65) Prior Publication Data

US 2015/0000155 A1 Jan. 1, 2015

(30) Foreign Application Priority Data

Feb. 3, 2012 (JP) ..... 2012-022537
Feb. 6, 2012 (JP) ..... 2012-023417

(51) Int. Cl.
*F26B 3/02* (2006.01)
*F26B 21/00* (2006.01)
(Continued)

(52) U.S. Cl.
CPC ..... *F26B 3/02* (2013.01); *B41F 23/04* (2013.01); *B41M 7/009* (2013.01); *F26B 3/04* (2013.01);
(Continued)

(58) Field of Classification Search
CPC ..... F26B 3/02; F26B 21/003; F26B 25/14; F26B 3/04; F26B 21/00; B41M 7/009; B05D 3/0272; B41F 23/04
See application file for complete search history.

(56) References Cited

U.S. PATENT DOCUMENTS

2009/0320315 A1 12/2009 Horiba et al.
2010/0192402 A1 8/2010 Yamaguchi et al.

FOREIGN PATENT DOCUMENTS

CN 101970232 2/2011
JP 2008-151391 7/2008
(Continued)

OTHER PUBLICATIONS

Office Action issued in Taiwan Counterpart Patent Appl. No. 102105968, dated Oct. 5, 2015, along with an English translation thereof.
(Continued)

*Primary Examiner* — Jessica Yuen
(74) *Attorney, Agent, or Firm* — Greenblum & Bernstein, P.L.C.

(57) ABSTRACT

An ink drying method and device is provided for injection energy to overheated dry vapor in which saturated moisture vapor is heated and dried so as to miniaturize and cluster particles of the overheated dry vapor; apply impact energy
(Continued)

to the clustered overheated dry vapor so as to further miniaturize the clustered particles of the overheated dry vapor and generate nano-size overheated dry vapor; and supply the nano-size overheated dry vapor in a supersaturated state into a chamber in which a substrate is placed to form an anoxic atmosphere within the chamber, infuse the nano-size overheated dry vapor into ink molecules and molecular boundaries in the anoxic atmosphere, and apply the energy of the nano-sized overheated dry vapor to the ink, so as to evaporate the moisture of the ink and degraded or reduced the organic solvent of the ink.

4 Claims, 17 Drawing Sheets

(51) Int. Cl.

| | |
|---|---|
| ***F26B 25/14*** | (2006.01) |
| ***B41F 23/04*** | (2006.01) |
| ***F26B 3/04*** | (2006.01) |
| ***B41M 7/00*** | (2006.01) |
| *B05D 3/02* | (2006.01) |

(52) U.S. Cl.
CPC ..... *F26B 21/00* (2013.01); *F26B 21/003* (2013.01); *F26B 25/14* (2013.01); *B05D 3/0272* (2013.01)

(56) References Cited

FOREIGN PATENT DOCUMENTS

| | | |
|---|---|---|
| JP | 2011-58068 | 3/2009 |
| JP | 2011-64406 | 3/2011 |
| JP | 5002012 | 8/2012 |
| WO | 2008/117624 | 10/2008 |
| WO | 2009/013800 | 1/2009 |

OTHER PUBLICATIONS

Search report from P.C.T., mail date is May 14, 2013.

FIG. 16

TEST AT 170°C

| No.1 | No.2 | No.5 | No.6 | No.9 | No.10 | No.13 | No.14 | No.17 | No.18 | No.21 | No.22 |
|---|---|---|---|---|---|---|---|---|---|---|---|
| 170°C-1min | 170°C-3min | 170°C-1min | 170°C-6min | 170°C-4min | 170°C-6min | 170°C-4min | 170°C-6min | 170°C-5min | 170°C-9min | 170°C-5min | 170°C-9min |
| × | ○ | △ | ○ | ○ | ○ | × | ○ | △ | ○ | ○ | ○ |

TEST AT 200°C

| No.3 | No.4 | No.7 | No.8 | No.11 | No.12 | No.15 | No.16 | No.19 | No.20 | No.23 | No.24 |
|---|---|---|---|---|---|---|---|---|---|---|---|
| 200°C-4min | 200°C-6min | 200°C-4min | 200°C-6min | 200°C-4min | 200°C-6min | 200°C-4min | 200°C-6min | 200°C-5min | 200°C-9min | 200°C-6min | 200°C-9min |
| ○ | ○ | ○ | ○ | △ | ○ | ○ | ○ | ○ | ○ | ○ | ○ |

INK DRYING METHOD AND INK DRYING DEVICE

TECHNICAL FIELD

The present invention relates to an ink drying method which shortens drying time of ink which is applied to a substrate not by simply utilizing overheated dry vapor but by modifying the overheated dry vapor to have optimal characteristics for drying the ink (modification of overheated dry vapor) and to a device thereof.

BACKGROUND ART

The method for drying the ink applied to the substrate is used for drying the ink applied to an epoxy-resin printed-circuit board, for example.

The ink drying method will be described. Areas for performing solder plating (e.g., land, through-hole, pad, and the like) are formed on the epoxy-resin printed-circuit board, and ink is applied in a finishing step of the printed-circuit board on which the areas for performing solder plating are formed.

In a case where ultraviolet curing ink is used as the ink applied to the board surface of the printed-circuit board, first, the ink is applied on the entire surface of the printed-circuit board where a copper leaf wiring is formed. Thereafter, the printed-circuit board on which the ink is applied is set in a preheating chamber and a warm current of air of 80° C. is blown to the ink on the printed-circuit board for 15 minutes.

Next, the copper leaf part of the pattern of the preheated printed-circuit board on which mainly the components are to be loaded is masked, and ultraviolet rays are irradiated to expose the areas other than the copper leaf part. Through the exposure processing, the unmasked areas other than the copper leaf part are exposed, and the ink in that areas is cured.

Next, developing processing is executed by using an alkali aqueous solution. When executing the developing processing, the ink in the unmasked areas other than the copper leaf part is cured by irradiation of the ultraviolet rays and remained on the printed-circuit board without being eliminated. Thus, protection and insulation of the copper leaf pattern other than the copper leaf part on which the components are to be loaded are maintained.

In order to fully cure the ink on the printed-circuit board at last, processing for blowing a warm current of air of 150° C. on the board surface of the printed-circuit board over 60 minutes to 90 minutes is executed.

Patent Document 1: Japanese Patent Application No. 2009-524328 (Re-publication of PCT international Publication)

However, because the processing for blowing a warm current of air of 150° C. on the printed-circuit board over 60 minutes to 90 minutes is executed, a thermal stress is given to the printed-circuit board.

Further, 60 minutes to 90 minutes of time is spent for drying the ink applied to the printed-circuit board, not only the manufacture efficiency becomes poor but also the warm current of air needs to be supplied continuously for 60 minutes to 90 minutes. Thus, it is difficult to save the energy.

OHMICHI Co., ltd that is one of the applicants of the present invention has developed a technique which uses overheated dry vapor for drying printed matters (Patent Document 1: Re-publication of PCT international Publication). This drying method may be employed as the method for drying the ink on the printed-circuit board described above.

The printed matter drying method mentioned above employs the structure which: observes a printed matter by an electron microscope; pays an attention to a fact that the printed matter is of sheet-like structure with the entangling fibers and there are pores opened through the top and back faces of the printed matter between the entangling fibers; and a part of overheated dry vapor is discharged by letting it through the pores. Thereby, an original structure (prevention of wrinkles, heat wrinkles, prevention of blisters) is constituted with which the printed matter retains the moisture content of about 7%.

For retaining the moisture content of about 7% as in the case of the printed matter, the structure of discharging a part of the overheated dry vapor by letting it through the pores is employed. However, in order to dry the ink applied to the printed-circuit board, the moisture content of the printed-circuit board is required to be close to zero as much as possible. Thus, the printed matter drying method cannot be applied directly for drying the ink applied to the printed-circuit board, and it is necessary to develop an original method for drying the ink applied to the printed-circuit board.

For developing the method for drying the ink on a substrate such as a printed-circuit board, it is important to dry the ink in a short time by lightening the thermal stress given to the substrate and the like.

It is an object of the present invention to provide an ink drying method which shortens drying time of ink which is applied to a substrate and lightens the thermal stress given to the substrate and the like to dry the ink not by simply utilizing overheated dry vapor but by modifying the overheated vapor to have optimal characteristics for drying the ink and to provide a device thereof.

DISCLOSURE OF THE INVENTION

The inventors et al. of the present invention have executed experiments on drying ink by blowing overheated dry vapor to the ink applied to a substrate to give an energy of nano-size overheated dry vapor to the ink applied to the substrate, and have acquired the knowledge of being able to evaporating the moisture in the ink without a question and being able to degrade and reduce an organic solvent.

Further, also acquired is the knowledge that it is necessary for the nano-size overheated dry vapor to be infiltrated into molecules and molecular interfaces of the ink in order to shorten the drying time of the ink and to lighten the thermal stress given to the substrate and the like when giving the energy of the nano-size overheated dry vapor to the ink.

Furthermore, also acquired is the knowledge that it is necessary to go through at least two stages of processing in which an injection energy is given to the overheated dry vapor for miniaturizing and clustering it, and a collision energy is given to the clustered nano-size overheated dry vapor to micronize it further for infusing the nano-size overheated dry vapor into the molecules and molecular interfaces of the ink.

Based on the knowledge described above, the inventors et al. of the present invention have completed an ink drying method for drying ink applied to a substrate, which includes: giving an injection energy to the overheated dry vapor acquired by drying saturated moisture vapor through applying heat for micronizing and clustering the vapor, and giving a collision energy to the clustered overheated dry vapor to further micronized it to generate nano-size overheated dry vapor; and supplying the nano-size overheated dry vapor in a supersaturated state to a chamber in which the substrate is placed to form an anoxic atmosphere in the chamber, and infusing the nano-size overheated dry vapor into molecules and molecular interfaces of the ink in the anoxic atmosphere to give an energy of the nano-size overheated dry vapor to the ink in order to evaporate moisture of the ink and to degrade and reduce an organic solvent.

Further, as an ink dying device for embodying the ink drying method, the inventors et. al., of the invention have built the structure which includes: a nano-sizing module which gives an injection energy to overheated dry vapor acquired by drying saturated moisture vapor through applying heat for micronizing and clustering particles of the overheated dry vapor, and gives a collision energy to the clustered overheated dry vapor to further micronize the particles of the clustered overheated dry vapor to generate nano-size overheated dry vapor; a chamber to which the nano-size overheated dry vapor is supplied from the nano-sizing module in a supersaturated state to form an anoxic atmosphere for drying ink; and a nano-size overheated dry vapor supplying module which blows the nano-size overheated dry vapor to the substrate inside the chamber to infuse the nano-size overheated dry vapor into molecules and molecular interfaces of the ink.

With the present invention described above, the overheated dry vapor is modified to the nano-size overheated dry vapor and the nano-size overheated dry vapor is infused to the molecules and molecular interfaces of the ink by going through at least the two stages of processing in which an injection energy is given to the overheated dry vapor for achieving miniaturizing and clustering it, and a collision energy is given to the clustered nano-size overheated dry vapor to micronize it. Therefore, the ink applied to the substrate can be dried in a short time.

As a result of experiments, it is found that the ink on the printed-circuit board can be dried through infusing for about 3 minutes the nano-size overheated dry vapor on which nano-sizing processing described above is performed by heating it to 170° C. into the ink applied in a thickness of about 20 μm on the printed-circuit board used as a substrate. Further, in the experiments, the same results were acquired even in the cases where not only the nano-size overheated dry vapor of 170° C. but also the nano-size overheated dry vapor of 180 to 210° C., for example, is used.

Conventionally, a warm current of air of 150° C. is blown to the printed-circuit board over 60 to 90 minutes. However, with the present invention, the time for drying the ink can be shortened to 3 minutes at 170° C., for example. Therefore, not only the thermal stress given to the substrate such as the printed-circuit board can be lightened greatly but also the energy can be saved.

BRIEF DESCRIPTION OF THE DRAWINGS

FIG. 16 is a chart showing the results acquired by checking the fixation rate of silk ink through applying the silk ink to a printed-circuit board and changing the drying time with the nano-size dry vapor of 170° C. and the nano-size dry vapor of 200° C.

BEST MODES FOR CARRYING OUT THE INVENTION

Next, embodiments of the present invention will be described in details by referring to the accompanying drawings.

As described above, the inventors et al. of the present invention have built the method for drying ink applied to a substrate by using nano-size dry vapor through executing experiments in which the ink is dried by blowing the overheated dry vapor to the ink applied to the substrate.

According to the knowledge acquired by the inventors et al. of the present invention, it is necessary for the nano-size overheated dry vapor to be infused into molecules and molecular interfaces of the ink in order to shorten the drying time of the ink and lighten the thermal stress given to the substrate and the like when giving the energy of the nano-size overheated dry vapor to the ink for drying the ink on the substrate.

Figure 1:
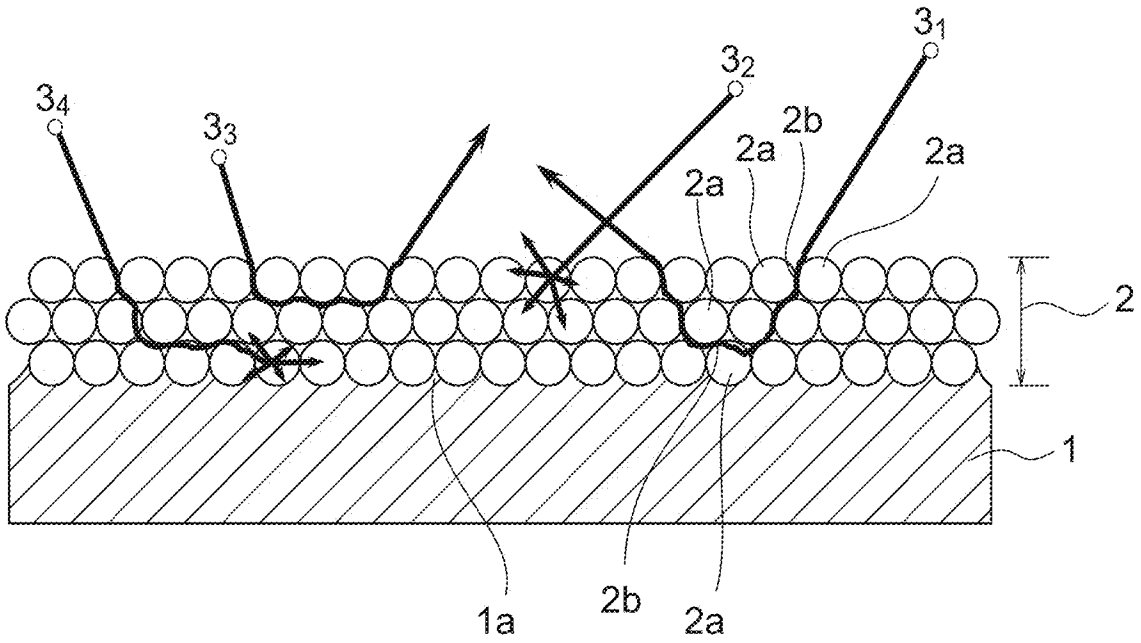
FIG. 1 is a chart for describing a mechanism for drying ink using nano-size overheated dry vapor according to the present invention.

The process for acquiring the above conclusion will be described. Referring to the ink applied to the substrate, ink shrinks in a process of drying and it exfoliates from the substrate when the surface of the substrate 1 is completely a mirror plane. Thus, as shown in FIG. 1, the board surface of the substrate is formed as a rough surface 1*a*. When ink 2 is applied to the board surface of the substrate 1, an organic solvent of the ink 2 enters into the dents and protrusions of the rough surface 1*a* of the substrate so that the ink 2 is tightly fitted to the board surface of the substrate 1 and fixed thereto.

Therefore, when the rough surface 1*a* of the substrate 1 is exposed to a high temperature of 150° C., for example, for a long time, e.g., for 60 minutes to 90 minutes, the rough surface 1*a* of the substrate 1 may possibly be slackened and the stickability with the ink 2 may be deteriorated so that the ink 2 may easily exfoliate.

Considering that the phenomenon described above may occur, it is necessary to shorten the time for giving a high-temperature heat energy when drying the ink.

Further, for drying the ink applied to the printed-circuit board, for example, it is dried by applying a heat energy from the surface of the ink applied to the substrate towards the inside. Incidentally, it is proposed to perform heating, preparing, and the like of food by using overheated dry vapor instead of a blast of high-temperature air. However, it is currently a fact that the proposal only pays an attention to the use of latent heat of the overheated dry vapor and the overheat mechanism at the molecule level has not been explicated.

The inventors et al. of the present invention have analyzed drying of the ink on the substrate at the molecular level, and have established it as an ink drying method based on the result of the analysis.

The drying of the ink on the substrate at the molecular level executed by the inventors et al. of the present invention will be described.

In Patent Document 1, ink on a printed matter is dried by generating overheated dry vapor of nano-order particles through jetting out overheated dry vapor from a nozzle. This is an optimum method for retaining the moisture content of about 7% in the printed matter through releasing a part of the overheated dry vapor to the pores of the printed matter.

However, there are non-permeable types having no pore and permeable types as the substrates on which ink is applied. It is unnecessary to keep the moisture content of 7% with those substrates unlike the case of the printed-circuit board. Rather, for those having wiring patterns and the like formed on the board surfaces thereof by using a copper leaf as in a case of a printed-circuit board that is an example of the substrate, it is desired to zero the moisture content in order to avoid corrosion of the wiring pattern.

Further, as the requirements for the ink applied on the printed-circuit board as an example of the substrate different from the ink on a printed matter, required are as follows: the electrical insulating characteristic is not deteriorated due to the changes over the years; deterioration is not caused by a thermal stress when mounting components to the printed-circuit board; exfoliation does not occur due to a tension stress; etc.

The ink used for the printed-circuit board as an example of the substrate often includes a component different from the ink of the printed matter, and it may often exhibit a characteristic such as having high viscosity and the like than the ink of the printed matter. Therefore, it is insufficient in some aspects for drying the ink on the substrate by the nano-order overheated dry vapor jetted out from the nozzle. Thus, it is necessary to build an original drying method for drying the ink on the substrate different from the ink of the printed matter.

The inventors et al. of the present invention have tried a technical analysis in a state where the ink is fixed to the printed-circuit board as an example of the substrate.

When the ink is fixed to the board surface of the substrate, an organic solvent of the ink 2 enters into the dents and protrusions of the rough surface 1*a* of the substrate 1 as shown in FIG. 1 when the ink is applied to the board surface of the substrate. Further, a surface tension works on the surface of the ink 2 applied to the board surface of the substrate 1, and a surface tension also works on the surfaces of individual molecules 2*a* which constitute the organic solvent of the ink. Furthermore, it is considered that a molecular interface force for coupling the molecules works on interfaces 2*b* between the molecules 2*a*, 2*a* which constitute the organic solvent of the ink and that the ink 2 is fixed to the board surface of the substrate 1 in combination of those.

Thereby, as shown in FIG. 1, the inventors et al. of the present invention generates nano-size overheated dry vapor 3 suited for being forcibly infused into the molecules 2*a* of the ink 2 and the molecular interfaces 2*b* in resistant to the surface tension and the molecular interface force.

Specifically, in the present invention, evaporation of the moisture of the ink 2 and degradation and reduction of the organic solvent are caused through: generating the nano-size overheated dry vapor 3 through executing at least two stages of nano-sizing processing in which the overheated dry vapor is micronized and clustered by applying an injection energy thereto and a collision energy is given to the clustered nano-size overheated dry vapor to micronize it further, then the nano-size overheated dry vapor 3 is forcibly infused into the molecules 2 and the molecular interfaces 2*b* of the ink 2; and giving the energy of the nano-size overheated dry vapor 3 to the ink 2.

As the process for drying the ink according to the present invention, as shown in FIG. 1, the nano-size overheated dry vapor 3 of the present invention undergoes at least the above-described two stages of nano-sizing processing so that it exhibits following behaviors.

That is, as shown in FIG. 1, a part of the nano-size overheated vapors 31, 33 forcibly infuses into the molecular interfaces 2*b* between the molecules 2*a*, 2*a* of the ink 2, and gives the energy of the nano-size overheated dry vapors 31, 33 to the molecular interfaces 2*b* of the ink 2 to cause evaporation of the moisture of the ink 2 as well as degradation and reduction of the organic solvent existing in the ink interfaces 2*b*.

Furthermore, a part of the nano-size overheated dry vapor 32 infuses into the inside of the molecules 2*a* of the ink 2 by overpowering the surface tension of the molecules 2*a* of the ink 2, and gives the energy of the nano-size overheated dry vapor 32 to the molecular interfaces 2*b* of the ink 2 to cause evaporation of the moisture of the ink 2 as well as degradation and reduction of the organic solvent existing inside the molecules 2*a* of the ink 2.

Moreover, a part of the nano-size overheated vapor 34 forcibly infuses into the molecular interfaces 2*b* of the ink 2, and gives the energy of the nano-size overheated dry vapor 34 to the molecular interfaces 2*b* of the ink 2 to cause evaporation of the moisture of the ink 2 as well as degradation and reduction of the organic solvent existing in the ink interfaces 2*b*. Not only that, a part of the nano-size overheated vapor 34 passes through the molecular interfaces 2*b* of the ink 2 to infuse into the inside of the molecules 2*a* of the ink 2 by overpowering the surface tension of the molecules 2*a* of the ink 2, and gives the energy of the nano-size overheated dry vapor 34 to the molecular interfaces 2*b* of the ink 2 to cause evaporation of the moisture of the ink 2 as well as degradation and reduction of the organic solvent existing inside the molecules 2*a* of the ink 2.

As described above, the nano-size overheated dry vapor 3 of the present invention undergoes at least the two stages of nano-sizing processing described above. Therefore, through the behaviors described by referring to FIG. 1, the time for drying the ink 2 applied to the substrate 1 can be shortened so that the ink drying time can be shortened. Thereby, the time for the thermal stress to be imposed upon the substrate 1 on which the ink 2 is applied can be shortened.

While the structure of giving an energy (mainly a thermal energy) infused into the molecules 2*a* and the molecular interfaces 2*b* of the ink 2 applied to the substrate 1 by executing the two stages of nano-sizing processing through giving an injection energy and a collision energy to the nano-size overheated dry vapor has been described above, the structure is not limited only to that. It is also possible to execute three stages of nano-sizing processing in which an excitation energy is further applied by an ultrasonic wave or an electromagnetic wave after adding the injection energy and the collision energy to the overheated dry vapor. When the excitation energy is applied in this manner, the particles of the nano-size overheated dry vapor are micronized in a hyperfine manner than the case of applying the collision energy and the hyperfine-micronized particles are to have the excitation energy. Thus, when the nano-size overheated dry vapor infuses into the molecules 2*a* and the molecular interfaces 2*b* of the ink 2, intermolecular vibration of the ink 2 and the molecular vibration in the molecular interfaces are promoted by the excitation energy, so that evaporation of the moisture in the ink 2 and degradation and reduction of the organic solvent can be promoted. When applying the excitation energy by the ultrasonic wave, it is desired to set the frequency thereof to be in a range of 30 kHz to 300 kHz. When applying the excitation energy by the electromagnetic wave, it is desired to set the frequency thereof to be in a range of 0.3 GHz to 400 THz. Note, however, that the use frequency of the ultrasonic wave and the wavelength of the electromagnetic wave are changed and set as appropriate depending on the components of the ink applied to the substrate and the thickness and the like applied to the substrate.

Next, an ink drying device for embodying the ink drying method according to the embodiment of the present invention will be described.

Figure 2:
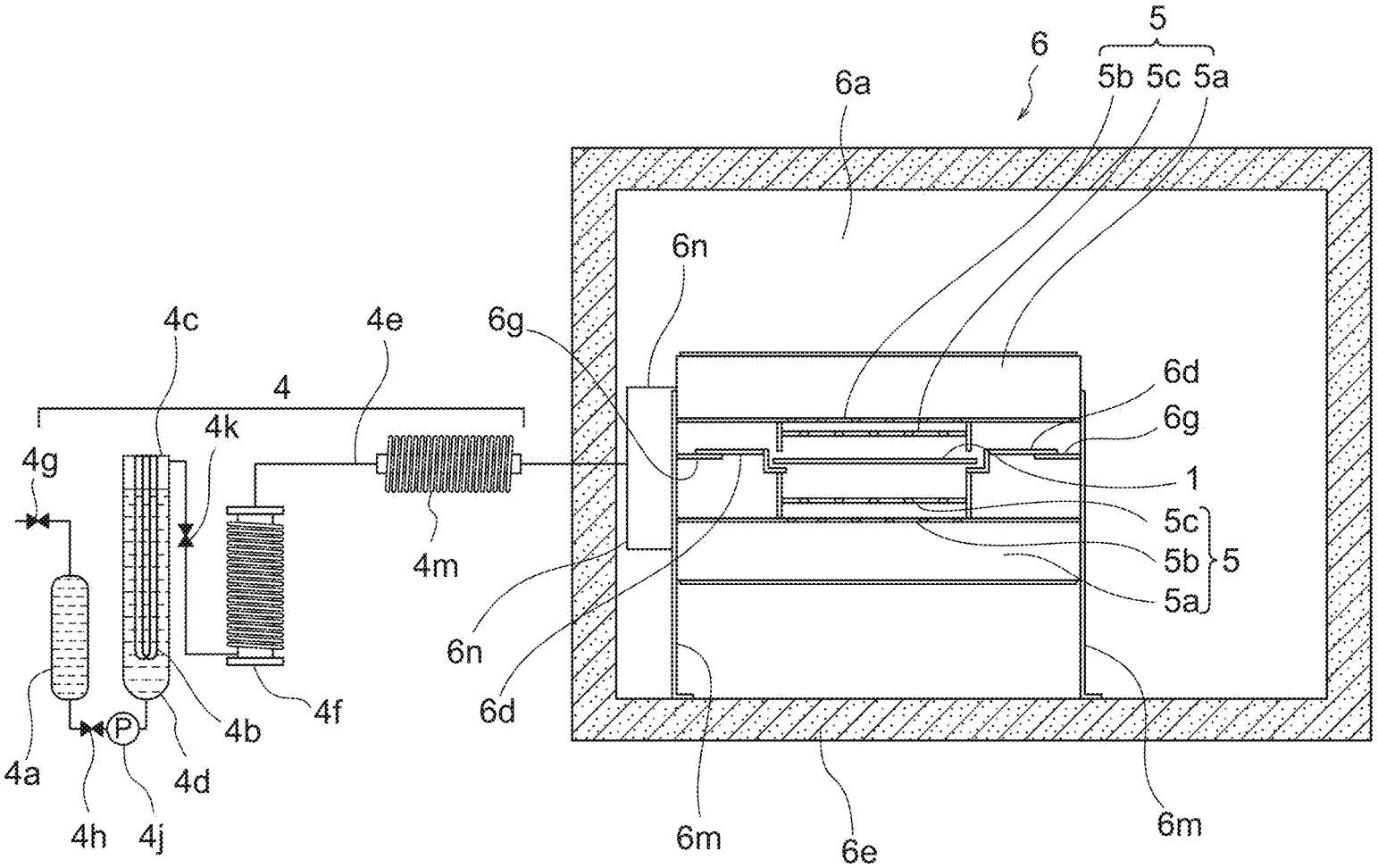
FIG. 2 is a block diagram showing an ink drying device using the nano-size overheated dry vapor according to the present invention.

As shown in FIG. 2, the ink drying device according to the embodiment of the present invention is built as a structure which includes: an overheated dry vapor generating module 4 which overheats saturated moisture vapor to the temperature of 170° C. to 210° C. to generate overheated dry vapor; a nano-sizing module 5 which generates the nano-overheated dry vapor 3 through performing at least two stages of nano-sizing processing on the generated overheated dry vapor; a chamber 6 in which an anoxic atmosphere for drying the ink 2 is formed by supplying the nano-size overheated dry vapor from the nano-sizing module 5 in a supersaturated state; and a nano-size overheated dry vapor supplying module 7 which infuses the nano-size overheated dry vapor 3 into the molecules 2*a* and the molecular interfaces 2*b* of the ink 2 as shown in FIG. 1 through blowing the nano-size overheated dry vapor 3 to the substrate 1 inside the chamber 6.

FIG. 2 shows an example of the overheated dry vapor generating module 4. The overheated dry vapor generating module 4 shown in FIG. 2 includes: a water softener 4*a* which accumulates tap water; a boiler 4*d* which generates saturated moisture vapor 4*c* by receiving soft water from the water softener 4*a* and heating it with a heater 4*b*; and an IH heater 4*f* which generates overheated dry vapor 4*e* by heating the saturated moisture vapor 4*c* generated by the boiler 4*d* to the temperature of 170 to 210° C. by an IH (electromagnetic induction heating) method. While the IH (electromagnetic induction heating) method by the IH heater 4*f* is employed as the method for heating the saturated moisture vapor to the temperature of 170 to 210° C., any other heating methods may be employed as long as the saturated moisture vapor can be heated to the temperature of 170 to 210° C.

An open/close valve 4*g* is attached at the mouth of the water softener 4*a*. An open/close valve 4*h* and a pump 4*j* for feeding water are attached between the water softener 4*a* and the boiler 4*d*, and the boiler 4*d* and the IH heater 4*f* are connected via an open/close valve 4*k*. As necessary, a re-heating device 4*m* may be connected to the output side of the IH heater 4*f*.

Note that the overheated dry vapor generating module 4 shown in FIG. 2 merely shows an example, and the structure thereof is not limited to the one shown in FIG. 2. The point is that the overheated dry vapor generating module 4 may be of any other structures as long as it has a function of generating the saturated moisture vapor 4*c* as the overheated dry vapor 4*e* by heating it to the temperature of 170° C. to 210° C. and drying it.

Figure 3:
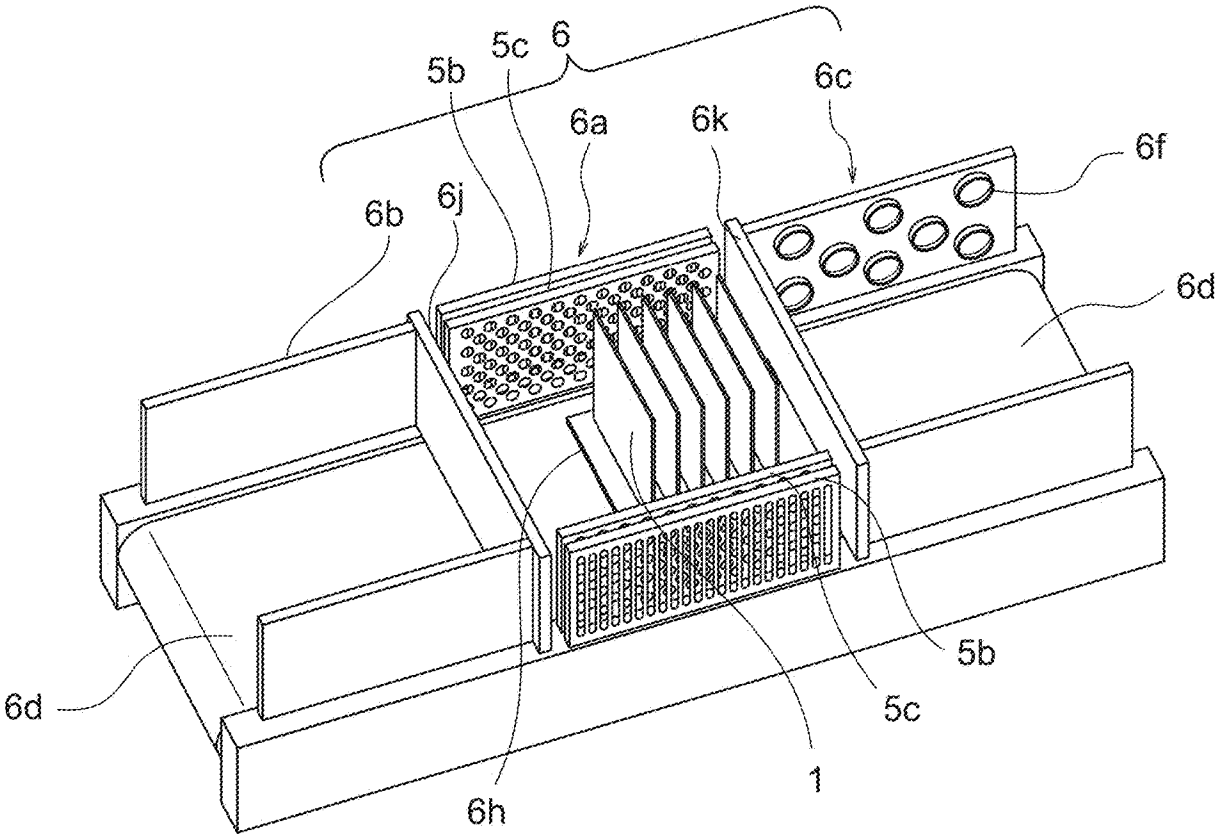
FIG. 3 is a perspective view showing a chamber of the ink drying device using the nano-size overheated dry vapor according to the present invention.

An example of the chamber 6 is shown in FIG. 2 and FIG. 3. The chamber 6 includes: a processing room 6*a* (FIG. 2) which accepts the nano-size overheated dry vapor 3 generated by the nano-sizing module 5 in a supersaturated state and forms an atmosphere of the nano-size overheated dry vapor 3 while keeping the temperature of 170° C. to 210° C.; and a preheating rook 6*b* and an annealing room 6*c* (FIG. 3) placed in a pre-stage and a post stage of the processing room 6*a*. A belt conveyor 6*d* (FIG. 2, FIG. 3) is placed over the pre-heating room 6*b*, the processing room 6*a*, and the annealing room 6*c*. Further, an open/close door 6*j* is provided between the annealing room 6*c* and the processing room 6*a* to form a structure with which the annealing room 6*c* and the processing room 6*a* are blocked from each other by closing the open/close door 6*j* while the pre-heating room 6*b* and the processing room 6*a* are connected by opening the open/close door 6*j* (FIG. 3). Similarly, an open/close door 6*k* is provided between the processing room 6*a* and the annealing room 6*c* to form a structure with which the pre-heating room 6*b* and the processing room 6*a* are blocked from each other by closing the open/close door 6*k* while the pre-heating room 6*b* and the processing room 6*a* are connected by opening the open/close door 6*k* (FIG. 3).

In FIG. 3, a send-in door for opening/closing and a ceiling of the pre-heating room 6*b*, a send-out door for opening/closing and a ceiling of the annealing room 6*c*, ad an external wall of the processing room 6*a* are omitted.

FIG. 2 shows the structure with which the substrate 1 is placed laterally and transported by the belt conveyor 6*d*. The substrate 1 is transported by having its left and right ends being supported by the belt conveyor 6*d*. FIG. 3 shows the structure with which the substrate 1 is placed longitudinally and transported by the belt conveyor 6*d*. The substrate 1 is transported by having its bottom end being supported by a jig 6*h*. The transporting methods shown in FIG. 2 and FIG.

3 are selected as appropriate by taking the number of the substrates 1 and the like into consideration.

The processing room 6*a* shown in FIG. 2A is in a structure of a constant-temperature tank in which waterproofing treatment is applied to the inner wall thereof and a heat insulation layer 6*e* is provided to the outer wall thereof. The pre-heating room 6*b* shown in FIG. 3 is in a structure in which a heater, not shown, is attached to the inner wall thereof for pre-heating the substrate 1 and the ink 2 transported into the processing room 6*a*. The annealing room 6*c* shown in FIG. 3 is in a structure in which a fan 6*f* is attached to the inner wall thereof to anneal the substrate 1 and the ink 2 heated in the processing room 6*a* for preventing water drops from being attached to the surfaces of the substrate 1 and the ink 2.

In the processing room 6*a* shown in FIG. 2, a guide part 6*g* for guiding the both ends of the belt conveyor 6*d* is attached to a stay 6*m*.

The chamber 6 shown in FIG. 2 and FIG. 3 merely shows an example, and the structure thereof is not limited only to that. The point is that the structure of the chamber 6 may be of any other structures as long as it has a function of accepting the nano-size overheated dry vapor in a supersaturated state and forming an atmosphere of the nano-size overheated dry vapor 3 while keeping the temperature of 170 to 210° C.

An example of the nano-sizing module 5 is shown in FIG. 2 and FIG. 4. The nano-sizing module 5 shown in FIG. 4 includes: transmission pipes 5*a*, 5*a* disposed by sandwiching the substrate 1; a nozzle plate 5*b* attached to an opening part that is opposed to the substrate 1 between the transmissions pipes 5*a*, 5*a*; and a vibration plate 5*c*.

The transmission pipes 5*a*, 5*a* are supported by the stays 6*m* within the processing room 6*a*, and those are connected to the output side of the IH heater 4*f* of the overheated dry vapor generating module 4 via a guide pipe 6*n*. As shown in FIG. 3 and FIG. 4A, a long thin nozzle 5*d* is opened in the nozzle plate 5*b*. The shape of the nozzle 5*d* is not limited only to that. The shape may be a round shape. The point is that any structures may be employed as long as it is a structure with which the overheated dry vapor 4*e* is clustered by micronizing it through giving an injection energy to the overheated dry vapor 4*e* by blowing the overheated dry vapor 4*e* guided into the transmission pipe 5*a* with a vapor pressure generated by the overheated dry vapor generating module 4.

Figure 6:
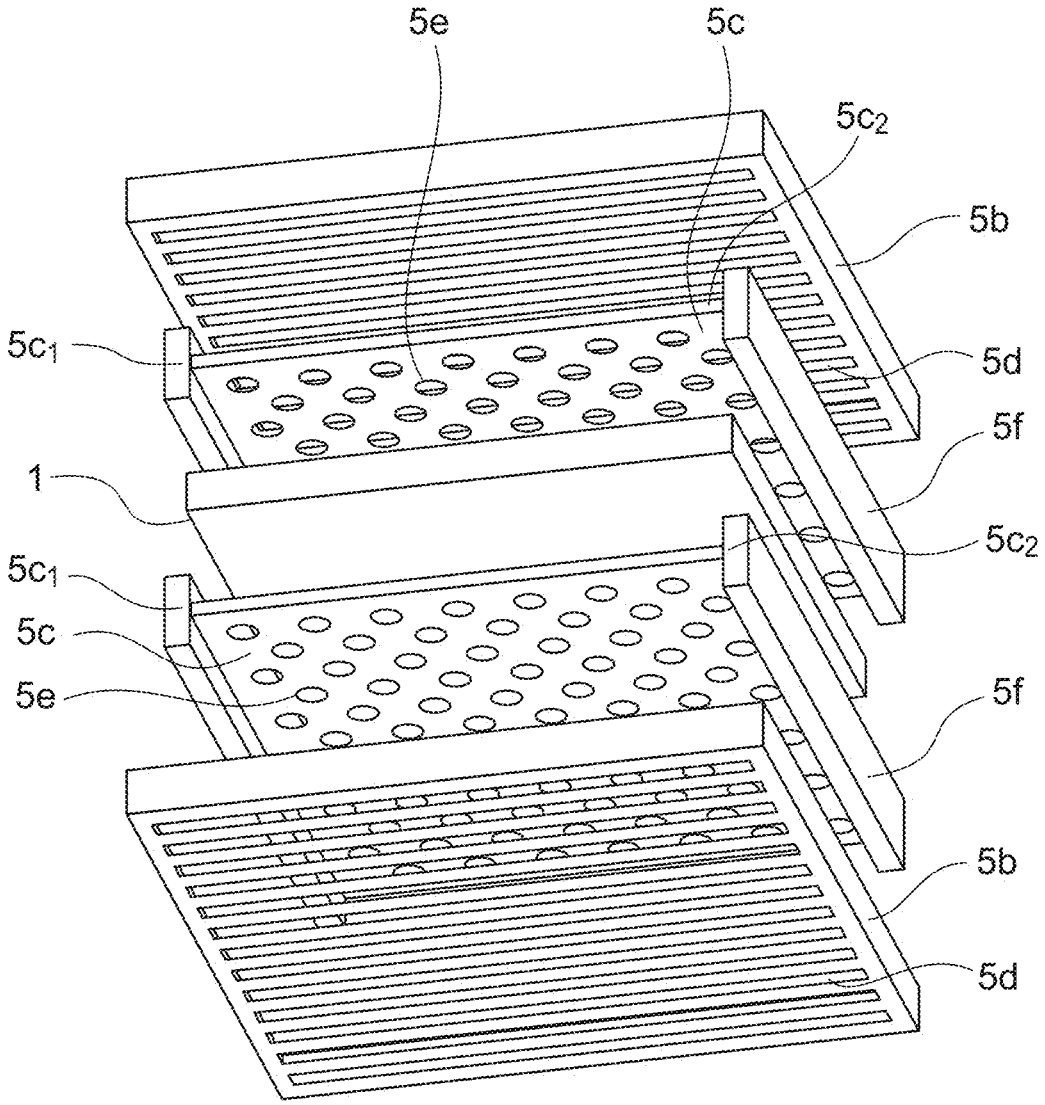
FIG. 6 is a perspective view showing the relation between the nano-sizing module of the ink drying device using the nano-size overheated dry vapor according to the present invention and a substrate.

As shown in FIG. 4A and FIG. 6, the vibration plate 5*c* is disposed in front of the nozzle plate 5*b*, and a plurality of nozzles 5*e* are provided. The nozzle 5*e* is opened at a position shifted with respect to the nozzle 5*d* of the nozzle plate 5*b*. The overheated dry vapor 4*e* clustered by the nozzle plate 5*b* collides with the board surface of the vibration plate 5*c* and a collision energy is given thereby, so that the clustered overheated dry vapor 4*e* is further micronized to generate the nano-size overheated dry vapor 3.

While described above is the case of generating the nano-size overheated dry vapor 3 by going through the two stages of processing with which an injection energy ejected out from the nozzle 5*d* of the nozzle plate 5*b* for achieving micronization and clustering and with which the particles clustered by receiving a collision energy through colliding with the board surface of the vibration plate 5*c* are further micronized, the way of generating it is not limited only to that.

Figure 4B:
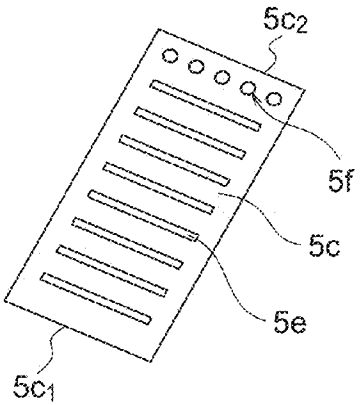
FIGS. 4B and 4C are perspective views showing modification examples of an vibration plate used in the nano-sizing module.
Figure 4C:
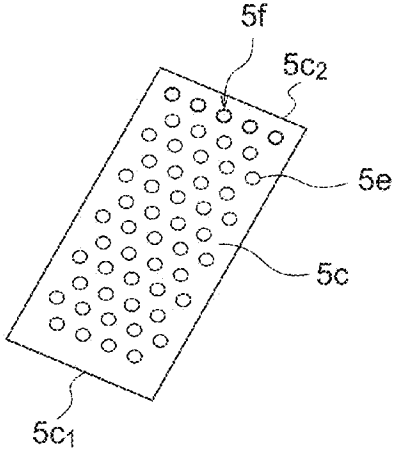
Figure 4A:
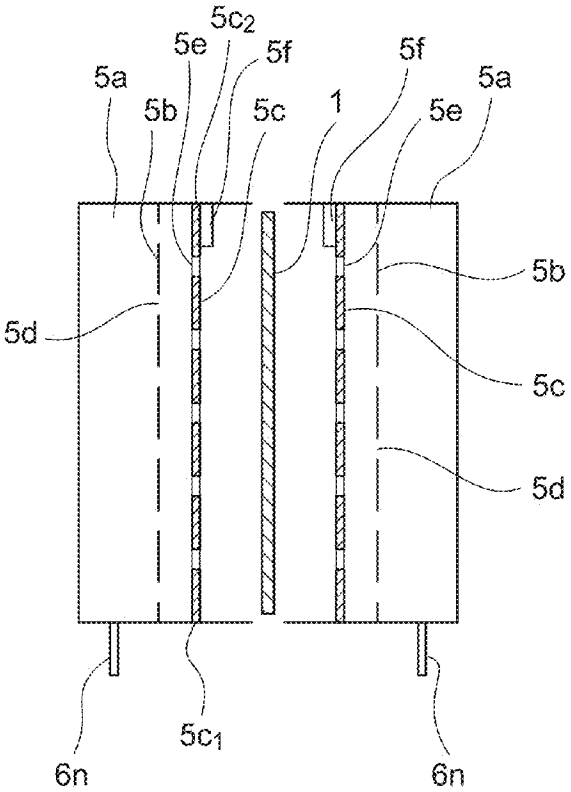
FIG. 4A is a block diagram showing a nano-sizing module in the ink drying device using the nano-size overheated dry vapor according to the present invention.
Figure 5:
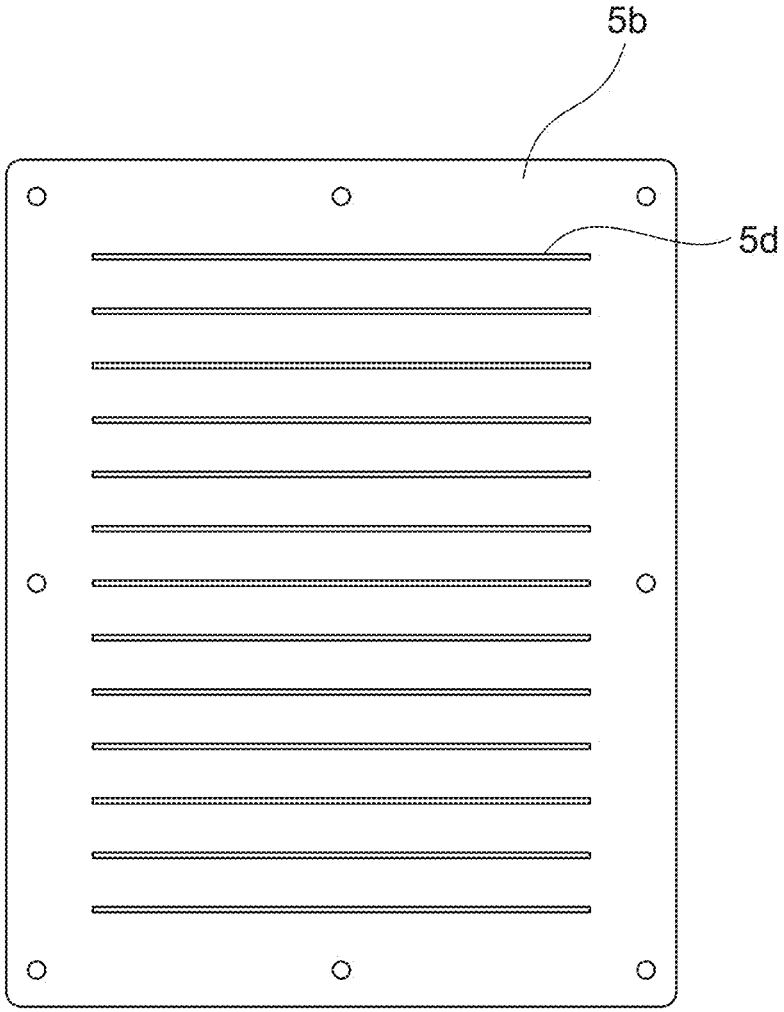
FIG. 5 is an elevational view showing an example of a nozzle plate of the ink drying device using the nano-size overheated dry vapor according to the present invention.

That is, as shown in FIG. 4 and FIG. 6, it is also possible to employ a structure which modifies the overheated dry vapor to the nano-size overheated dry vapor 3 by going through three stages of nano-sizing processing with which: an end $5c_1$ of the vibration plate 5*c* is fixed; and an ultrasonic wave vibration element 5*f* is mounted to the other end 5*c*7, an excitation energy is given to the vibration plate 5*c* by the ultrasonic wave vibration element 5*f* to perform hyperfine micronization to give an excitation energy to the overheated dry vapor 4*e* further micronized by colliding with the board surface of the vibration plate 5*c* to achieve hyperfine micronization. The nozzle 5*e* opened in the vibration plate 5*c* may be of a long thin type as shown in FIG. 4B or may be of a circular pore type as shown in FIG. 4C. The point is that any shapes may be employed as long as it is a shape which can radiate the nano-size overheated dry vapor 3, which has collided with the vibration plate 5*c* and has undergone the two stages or three stages of nano-sizing processing, towards the substrate 1.

The nano-size overheated dry vapor supplying module 7 includes the nozzle Se of the vibration plate 5*c* shown in FIG. 4A, which is in a structure with which the nano-size overheated dry vapor 3 is infused into the molecules 2*a* and the molecular interfaces 2*b* of the ink 2 as shown in FIG. 1 from the nozzle Se of the vibration plate 5*c* by a vapor pressure generated by the overheated dry vapor generating module 4.

Next, the process for drying the ink 2 applied to the board surface of the substrate 1 by using the ink drying device shown in FIG. 1 will be described.

First, as shown in FIG. 2, the saturated moisture vapor 4*c* is generated by the overheated dry vapor generating module 4. Further, the overheated dry vapor 4*e* is generated by heating the saturated moisture vapor 4*c* to the temperature of 170 to 210° C. and dried.

Then, the overheated dry vapor 4*e* outputted from the overheated dry vapor generating module 4 is guided inside the transmission pipe 5*a* of the processing room 6*a* by the pump 4*j* and jetted out from the nozzle 5*d* of the nozzle plate 5*b* towards the board surface of the vibration plate 5*c*. In a case of the three stages of nano-sizing processing, an ultrasonic wave is applied to the vibration plate 5*c* by the ultrasonic wave vibration element 5*f*.

When ejected from the nozzle 5*d* of the nozzle plate 5*b*, the injection energy is given to the overheated dry vapor 4*e* to be micronized and clustered. The clustered overheated dry vapor collides with the board surface of the vibration plate 5*c* and receives a collision energy, so that the particles thereof are further micronized and generated as the nano-size overheated dry vapor. When an excitation energy by the ultrasonic wave is given to the vibration plate 5*c*, the excitation energy is given to the nano-size overheated dry vapor so that it is further micronized in a hyperfine manner to be modified into the nano-size overheated dry vapor 3 that is further nano-sizing processed.

The nano-size overheated dry vapor 3 is jetted out in a supersaturated state from the nozzle 5*e* of the vibration plate 5*c* to the inside of the processing room 6*a* by the vapor pressure generated by the overheated dry vapor generating module 4, so that an anoxic atmosphere is formed inside the processing room 6*a* by the nano-size overheated dry vapor 3 that is heated to the temperature of 170 to 210° C. The nano-size overheated dry vapor 3 is continuously supplied to the processing room 6*a* from the nozzle 5*e* of the vibration plate 5 while discarding a part of the nano-size overheated dry vapor 3 to supply the nano-size overheated dry vapor 3 in a supersaturated state inside the processing room 6*a* for making the surrounding of the belt conveyor 6*d* be in an anoxic atmosphere.

In the meantime, the substrate 1 to which the ink 2 is applied is pre-heated in the pre-heating room 6*b*. When the temperature thereof reaches the pre-heat temperature, it is transported to a set position of the processing room 6*a* by the belt conveyor 6*d*. The nano-size overheated dry vapor 3 is blown in an anoxic atmosphere to the substrate 1 transported into the processing room 6*a* from the nozzle 5*e* of the vibration plate 5*c*.

As shown in FIG. 1, the nano-size overheated dry vapor 3 blown out from the nozzle 5*e* of the vibration plate 5*c* is forcibly infused into the molecules 2*a* and the molecular interfaces 2*b* of the ink 2 on the substrate 1 so that evaporation of the moisture of the ink 2 and degradation and reduction of the organic solvent are promoted as described in FIG. 1.

The substrate 1 with the dried ink 2 is transported out from the processing room 6*a* into the annealing room 6*c* by the belt conveyor 6*d*, and cooled by the fan 6*f* of the annealing room 6*c*.

Next, a product whose ink on the substrate is dried by using the ink drying method according to the embodiment of the present invention was evaluated. For evaluating the product, there may be considered a case of using the nano-size overheated dry vapor acquired by the three stages of nano-sizing processing with which an injection energy, a collision energy, and an excitation energy are given and a case of using the nano-size overheated dry vapor acquired by the two stages of nano-sizing processing with which an excitation energy is not given. The energy of the nano-size overheated dry vapor by the three stages of nano-sizing processing is greater than that of the two stages of nano-sizing processing, so that the infusion capacity and the energy thereof given to the molecules and the molecular interfaces of the ink are also greater.

Considering that, the evaluation of the product was executed by using the nano-size overheated dry vapor generated acquired by the two stages of processing that is slightly inferior with respect to that generated by the three stages of nano-sizing processing and by making a comparison with a conventionally executed case where the ink is dried by applying overheat through blowing a warm air of 150° C. for 60 to 90 minutes to judge the superiority. Therefore, it is indirectly verified that drying of the ink by the three stages of nano-sizing processing is superior to the conventional method when drying of the ink by the two stages of nano-sizing processing is superior to that of the conventional case.

For making a comparison with the conventionally executed case where the ink is dried by applying overheat through blowing a warm air of 150° C. for 60 to 90 minutes, a printed-circuit board to which provisional curing processing of ink was done with a warm air of 80° C. for 15 minutes was used. The film thickness of the ink was 20 μm. The ink used was a product name CA-40G24 of TAIYO INK MFG, CO., LTD, for example, and the curing agent used was an agent acquired by mixing a product name PSR-4000 G24K of the same company.

Figure 7A:
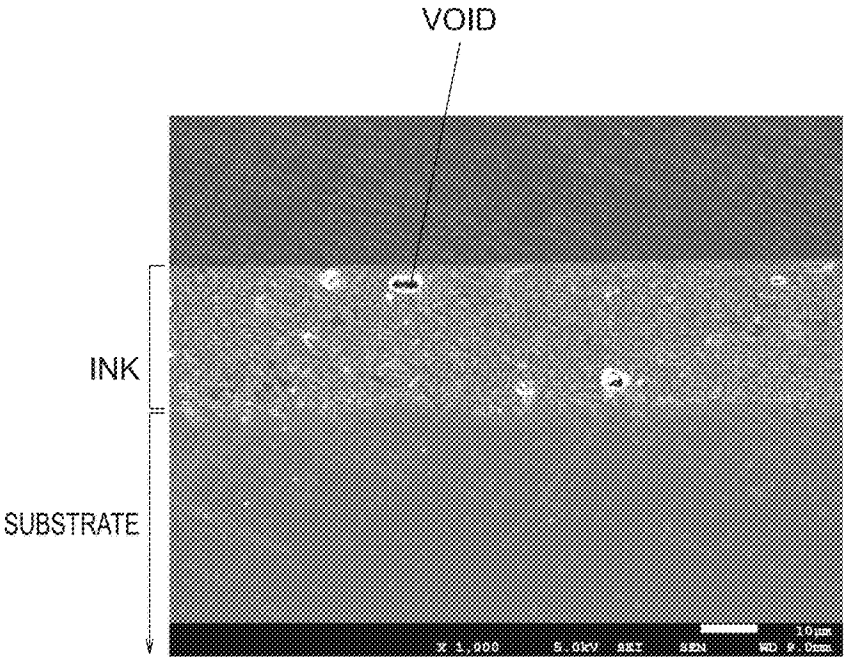
FIGS. 7A and 7B show SEM images acquired by observing, by SEM, ink sectional views of a substrate on which ink is applied in a thickness of 20 μm and it is dried by blowing nano-size overheated dry vapor of 170° C. for 5 minutes.
Figure 7B:
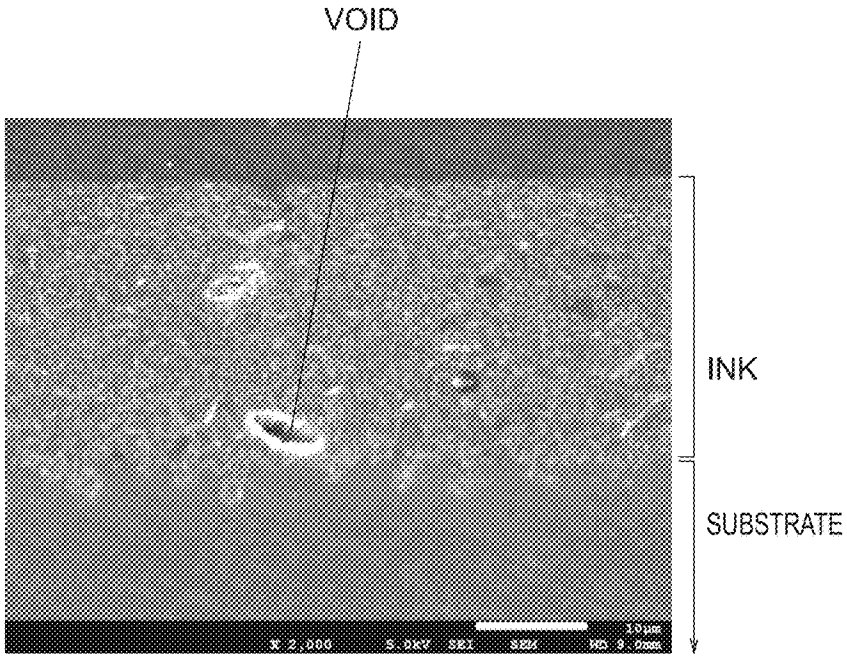

FIG. 7A and FIG. 7B are SEM images of the sectional view of the ink on the substrate dried for 5 minutes by the nano-size overheated dry vapor of 170° C. observed by SEM. FIG. 7A is an SEM image of 1,000 magnifications, and FIG. 7B is an SEM image of 2,000 magnifications.

After being dried, voids are formed in a part of the ink 2 applied to the substrate. The size of the void B is smaller than the volume of the nano-size overheated dry vapor of 170° C. and thinner than the film thickness of the ink 2. Thus, the board surface of the substrate is not exposed through the voids.

Figure 8B:
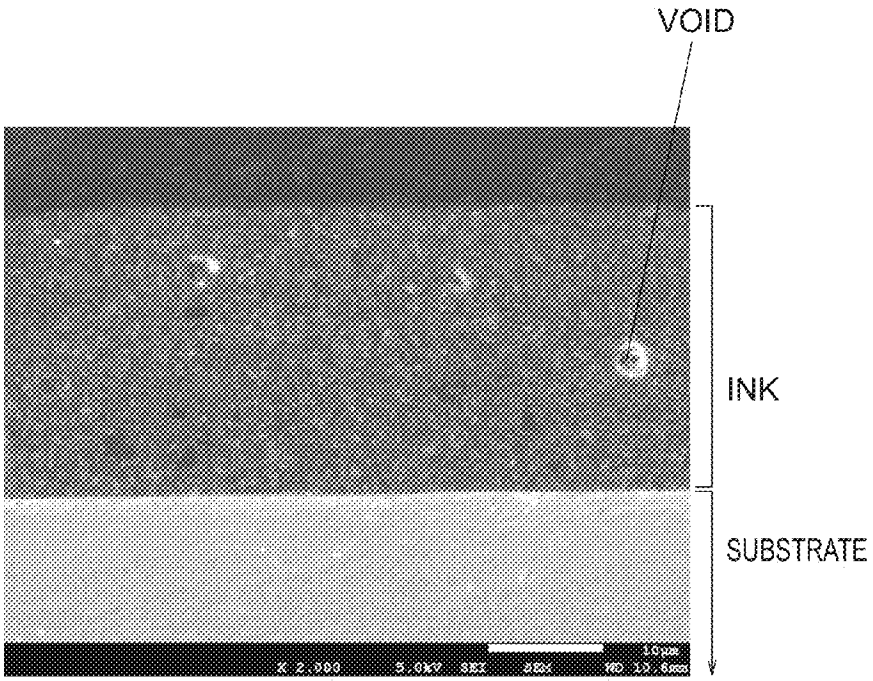
FIGS. 8A and 8B show SEM images acquired by observing, by SEM, ink sectional views of a substrate on which ink is applied in a thickness of 20 μm and it is dried by blowing nano-size overheated dry vapor of 200° C. for 5 minutes.
Figure 8A:
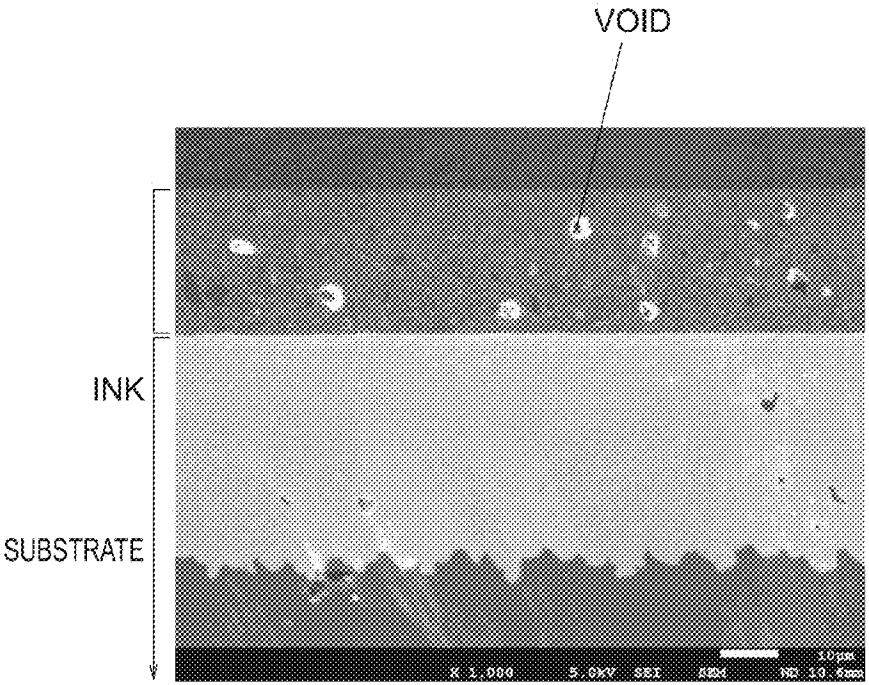

FIG. 8A and FIG. 8B are SEM images of the sectional view of the ink on the substrate dried for 5 minutes by the nano-size overheated dry vapor of 200° C. observed by SEM. FIG. 8A is an SEM image of 1,000 magnifications, and FIG. 8B is an SEM image of 2,000 magnifications.

After being dried, voids are formed in a part of the ink 2 applied to the substrate. The size of the void B is thinner than the film thickness of the ink 2. Thus, the board surface of the substrate is not exposed through the voids.

Figure 9:
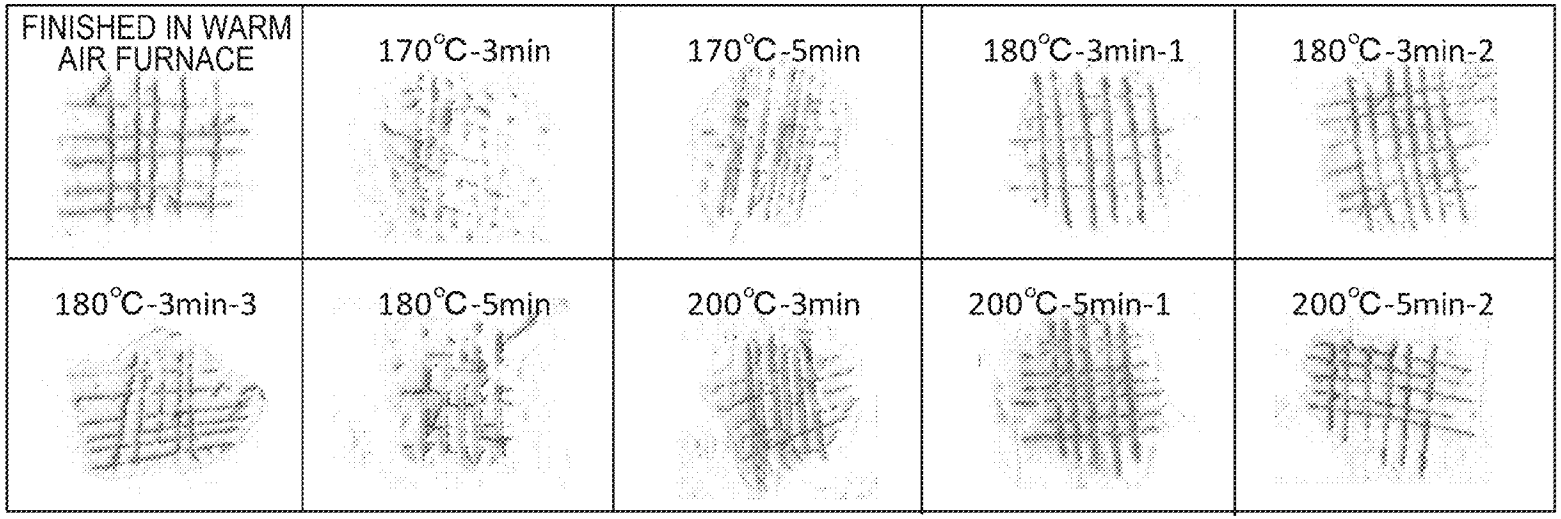
FIG. 9 is a chart showing the result acquired by checking the attached degree of the ink on the substrate.

FIG. 9 is a chart showing the result acquired by checking the attached degree of the ink on the substrate by suing a crosscut method (a crosscut testing method). FIG. 9 shows the results of: a conventional case where the ink was dried by a warm air of 150° C. for 60 minutes (finished in a warm air furnace); a case where the ink was dried by the nano-size overheated dry vapor of 170° C. for 3 minutes (170° C.-3 min); a case where the ink was dried by the nano-size overheated dry vapor of 170° C. for 5 minutes (170° C.-5 min); a case where the ink was dried by the nano-size overheated dry vapor of 180° C. for 3 minutes (180° C.-3 min-1, 180° C.-3 min-2, 180° C.-3 min-3); a case where the ink was dried by the nano-size overheated dry vapor of 200° C. for 3 minutes (200° C.-3 min); and a case where the ink was dried by the nano-size overheated dry vapor of 200° C. for 5 minutes (200° C.-5 min-1, 200° C.-5 min-2). Regarding the attached degree of ink to the tape, the more the black points, the more the ink is transcribed to the cellophane adhesive tape.

Compared to the conventional case where the finishing is done in the warm air furnace, the case of drying the ink in the conditions of 170° C.-3 to 5 min according to the present invention was most excellent. The ink attached degree for the substrate was within a practical use range even under the temperature of 180 to 200° C.

Figure 10:
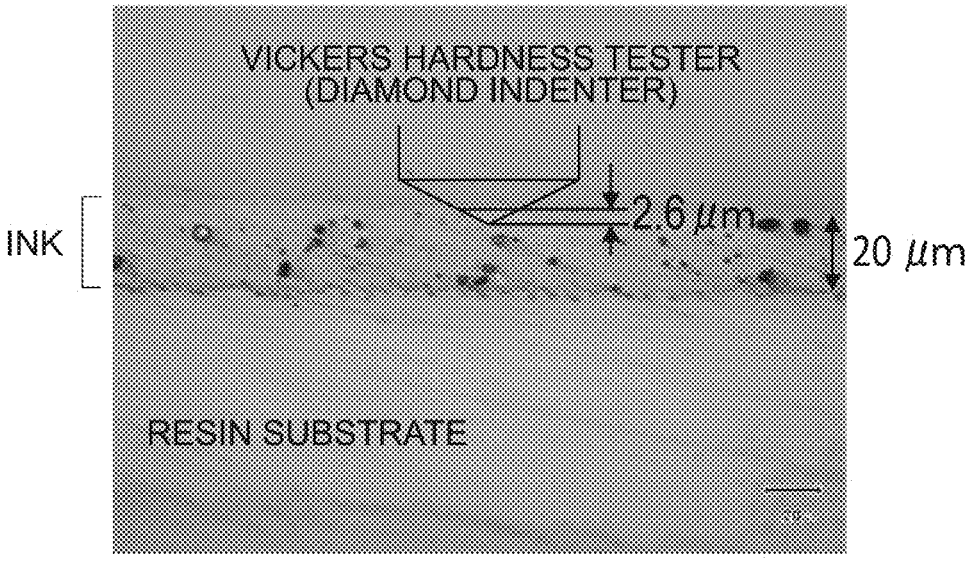
FIG. 10 is a microscopic photo showing a sectional view when testing the hardness of the ink after being dried.

FIG. 10 shows a sectional view when the hardness of the ink after being dried was tested. From the sectional view, the film thickness of the ink applied to a printed-circuit board (a resin substrate) as an example of the substrate was 20 μm. When the depth d of the indentation at the time of testing the hardness of the ink is acquired by multiplying 1/7 to the diagonal length, it is found that the test was conducted in the vicinity of 2.6 μm from the surface of the ink. Thus, it is considered as sufficiently objective data.

Figure 11:
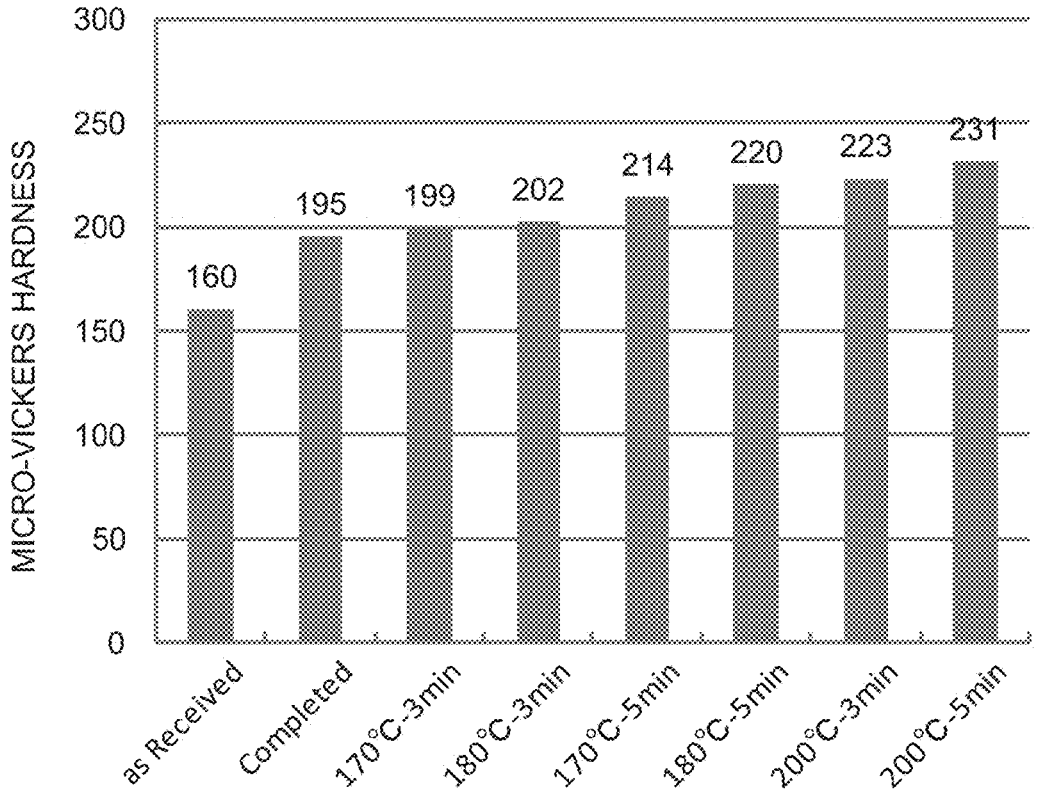
FIG. 11 is a graph showing the test result acquired by a Vickers hardness testing machine shown in FIG. 10.

FIG. 11 is a graph showing a test result acquired by a Vickers hardness testing machine shown in FIG. 10. The longitudinal axis of FIG. 11 shows the micro-Vickers hardness (MHV), and the lateral axis shows samples. The sample "as Received" is a conventional sample in a provisionally hardened state dried by a warm air of 80° C. for 15 minutes. "Completed" is a sample that is in a fully-dried state by further applying a warm air of 150° C. for 60 minutes on the conventional sample that is in a provisionally cured state. "170° C.-3 min" is a sample acquired by drying the ink by the nano-size overheated dry vapor of 170° C. for 3 minutes, "180° C.-3 min" is a sample acquired by drying the ink by the nano-size overheated dry vapor of 180° C. for 3 minutes, "170° C.-5 min" is a sample acquired by drying the ink by the nano-size overheated dry vapor of 170° C. for 5 minutes, "180° C.-5 min" is a sample acquired by drying the ink by the nano-size overheated dry vapor of 180° C. for 5 minutes, "200° C.-3 min" is a sample acquired by drying the ink by the nano-size overheated dry vapor of 200° C. for 3 minutes, and "200° C.-5 min" is a sample acquired by drying the ink by the nano-size overheated dry vapor of 200° C. for 5 minutes. In a case of drying with the nano-size overheated dry vapor of 210° C., also acquired was the result showing that there is no problem in using it practically.

It is verified that the ink drying method according to the present invention can acquire the hardness equivalent to the conventional product or more than that by drying the ink with the nano-size overheated dry vapor heated to the range of 170° C. to 210° C. for 3 to 5 minutes and that there is no problem for using it practically.

Figure 12A:
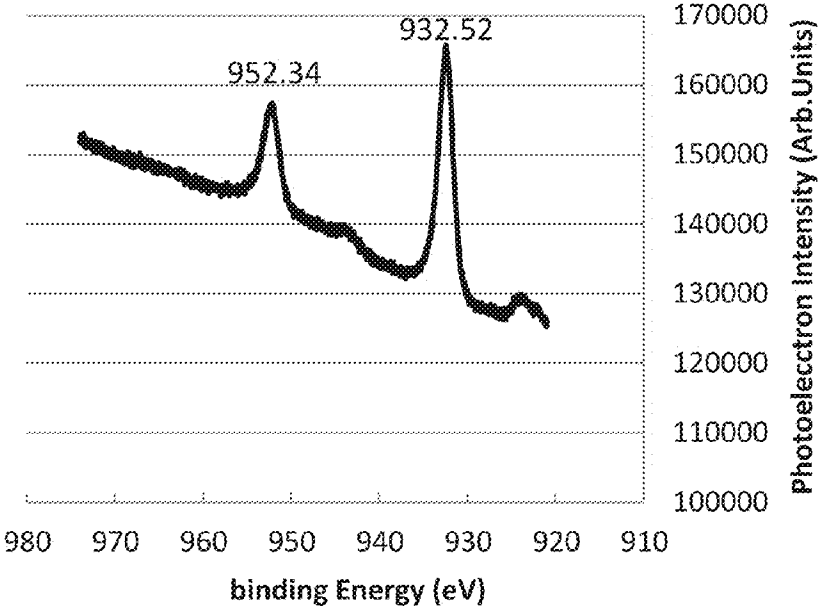
FIGS. 12A and 12B show graphs regarding the results acquired by checking the oxidation state on a copper leaf pattern of a printed-circuit board used as a substrate by using an X-ray photoemission spectroscopy method (XPS)
Figure 12B:
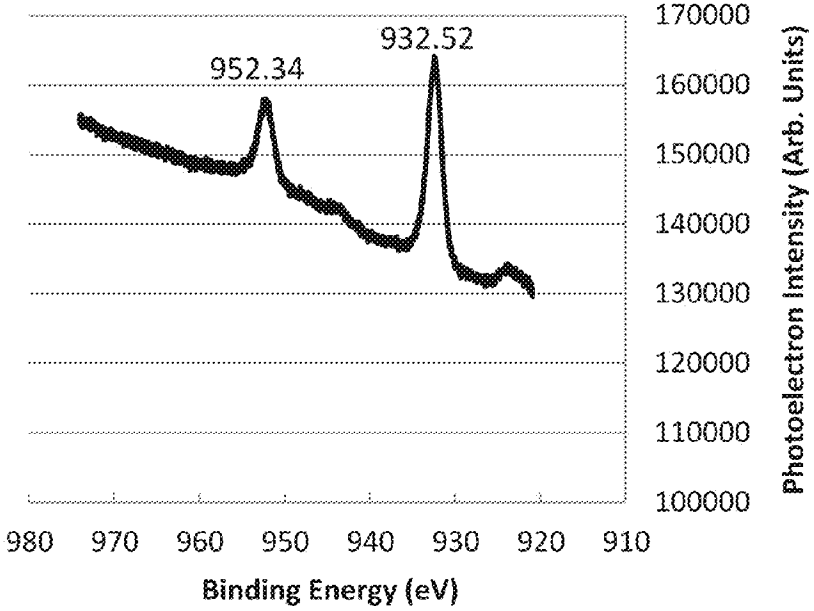
Figure 13A:
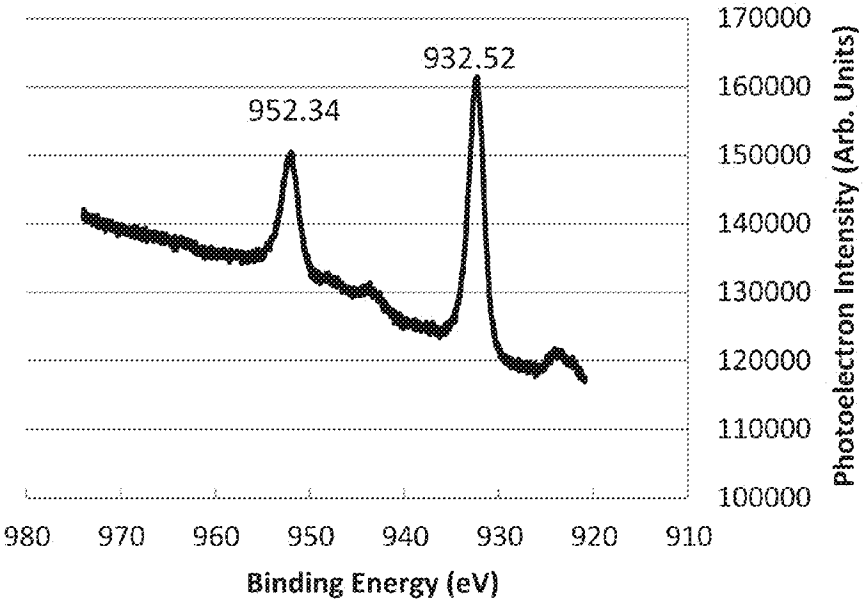
FIGS. 13A and 13B show graphs regarding the results acquired by checking the oxidation state on a copper leaf pattern of a printed-circuit board used as a substrate by using an X-ray photoemission spectroscopy method (XPS)
Figure 13B:
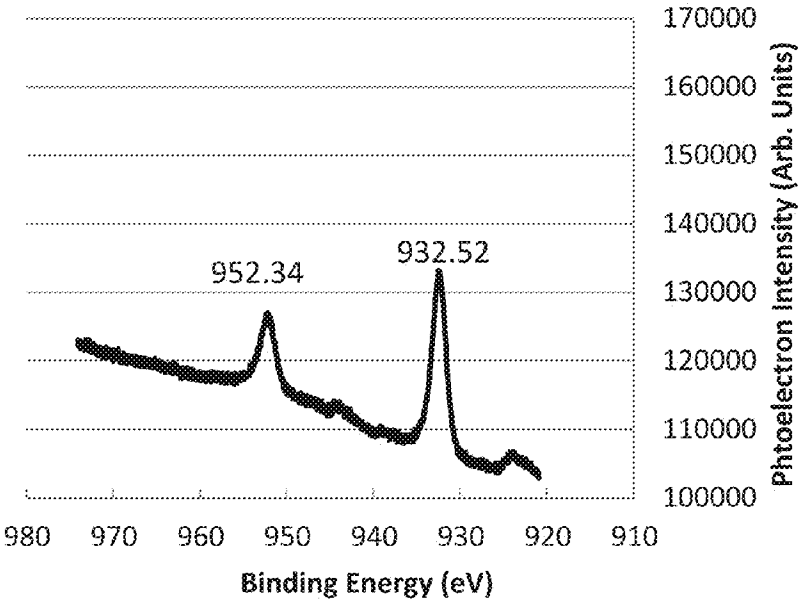

Next, the results acquired by checking the oxidation state on a copper leaf pattern of the printed-circuit board used as the substrate by using an X-ray photoemission spectroscopy (XPS) method are shown in FIGS. 12A-12B and FIGS. 13A-13B. FIG. 12A shows a conventional-case sample dried by a warm air of 150° C. for 60 minutes, and FIG. 12B shows a sample dried by the nano-size overheated dry vapor of 170° C. for 5 minutes. FIG. 13A shows a sample dried by the nano-size overheated dry vapor of 180° C. for 3 minutes, and FIG. 13B shows a sample dried by the nano-size overheated dry vapor of 200° C. for 3 minutes.

As a result, $Cu_2O$ was already generated in the copper leaf pattern even in the conventional-case sample dried by a warm air of 150° C. for 60 minutes. Almost the same $Cu_2O$ was generated by the processing of the present invention performed with the nano-size overheated dry vapor of 170 to 200° C., and no specifically new oxide was detected.

Therefore, it is found that there is no factor for promoting oxidation in the case of drying the ink using the nano-size overheated dry vapor compared to the conventional case of drying the ink by blowing a warn air of 150° C., since the ink is dried in an anoxic atmosphere by supplying the nano-size overheated dry vapor in a supersaturated state.

Figure 14:
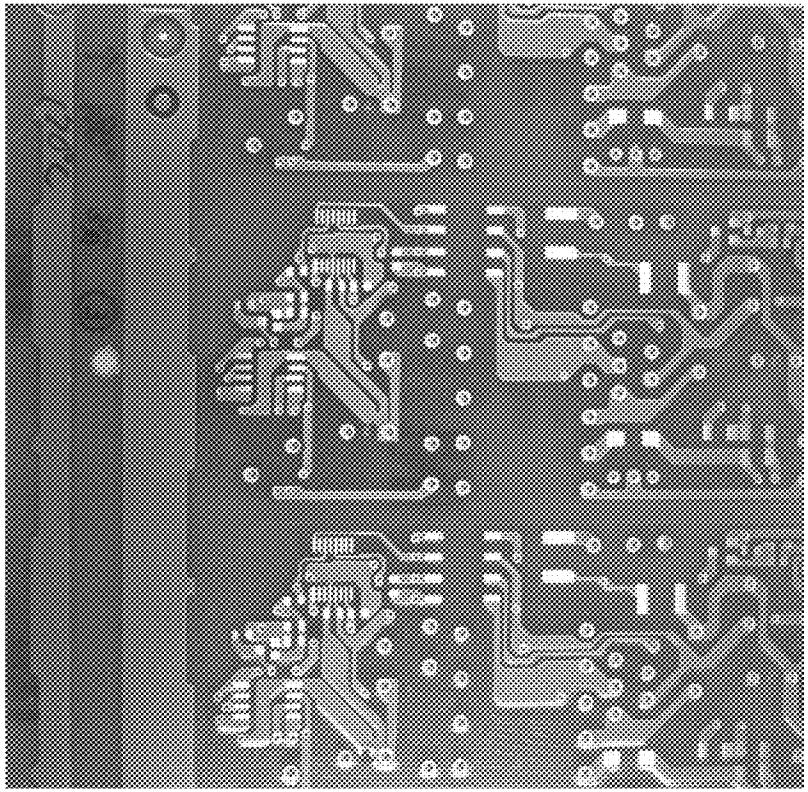
FIG. 14 is an external view showing a printed-circuit board in a state where it is dried for 3 minutes by nano-size overheated dry vapor of 170° C.

FIG. 14 is an external view showing a printed-circuit board dried by the nano-size overheated dry vapor of 170° C. for 3 minutes. From the external appearance, it is also found that damages are not given to the surface of the printed-circuit board by the nano-size overheated dry vapor.

Figure 15:
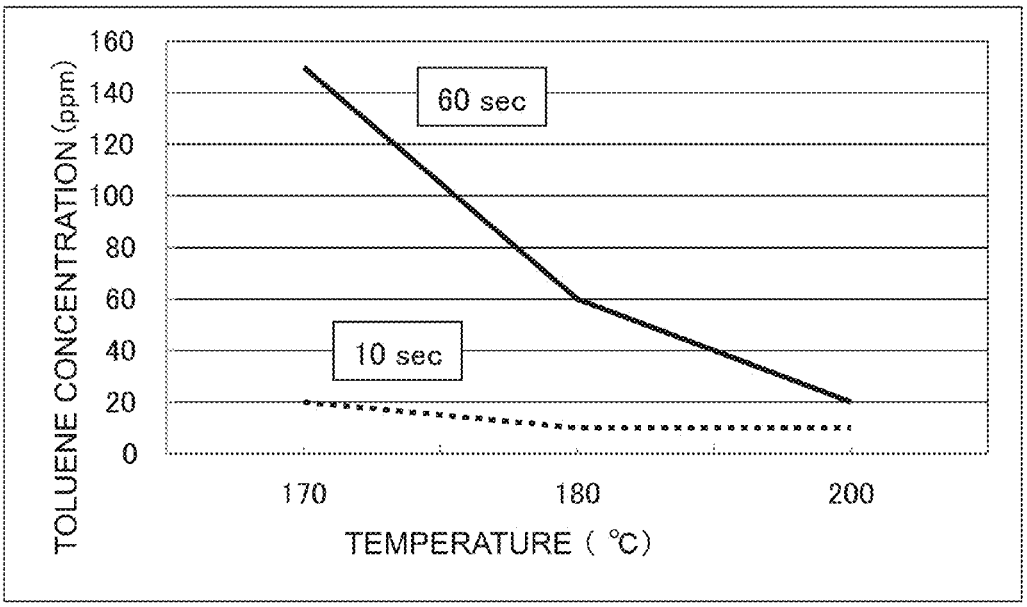
FIG. 15 is a graph showing changes in the toluene concentration generated by the overheated dry vapor.

FIG. 15 shows changes in the toluene concentration generated by the overheated dry vapor. The longitudinal axis shows the toluene concentration (ppm), and the lateral axis shows the processing temperature (° C.).

When toluene, xylene, benzene, and the like as aliphatic hydrocarbon solvents for ink are absorbed from the respiratory organs and skin of human body, mainly the liver and the central nervous system are damaged. Therefore, those are especially required to be treated attentively. If those aliphatic hydrocarbon solvents are degraded by the nano-size overheated dry vapor, it is revolutionary as a measure for environments. This was verified.

(1) The ink drying device using the nano-size overheated dry vapor according to the present invention is mounted in a box having an inside volume of 125 liters.

(2) Toluene of about 0.6 g was dropped in a processing room of the ink drying device, and the changes in the concentration were checked by using a gas detecting pipe. FIG. 15 shows the result.

After 10 seconds, toluene was slightly detected as 10 to 20 ppm. However, after 60 seconds, it was 150 ppm with the processing by the nano-size overheated dry vapor of 170° C., 60 ppm with the processing by the nano-size overheated dry vapor of 180° C., and 20 ppm with the processing by the nano-size overheated dry vapor of 200° C. The toluene concentration was decreased with the processing of higher temperatures.

From the results above, it was found that the concentration of the aliphatic hydrocarbon solvents (toluene, xylene, benzene, petroleum naphtha, and the like) were decreased by the temperature of the nano-size overheated dry vapor near 200° C. The details of the degradation mechanism are not clear without conducting verification. However, it is conjectured that toluene molecule chains are cut and changed into another product by a highly efficient thermolysis action caused by a high thermal energy of the nano-size overheated dry vapor.

Then, verification was conducted regarding a case where the present invention is applied for drying direct plotter silk ink.

Currently, when silk ink (white) is printed on a printed-circuit board after completely drying ink on the printed-circuit board and dried in a UV furnace, the silk ink is not fixed but exfoliated. Therefore, it is the actual circumstance that silk ink is printed on a printed-circuit board under a state where ink is half-dried and, thereafter, the silk ink and the half-dried ink are dried by applying heat in a heat furnace at 150° C. for 60 minutes in order to completely dry (fully dry) those inks.

For drying the direct plotter silk ink, considered are processing steps in which: ultraviolet exposure type ink is applied to a printed-circuit board as a substrate and it is heated at 80° C. for 15 minutes; exposure/developing processing is executed on the ink after being heated (pre-cure); silk ink is printed on the exposed/developed ink by an ink jet printer; and the ultraviolet exposure type ink and the silk ink are fully dried, and processing steps in which: ultraviolet exposure type ink is applied to a printed-circuit board as a substrate and it is heated at 80° C. for 15 minutes; exposure/developing processing is executed on the ink after being heated; the exposed/developed ink is fully dried (post-cure); silk ink is printed on the fully dried ink by an ink jet printer; and the silk ink is filly dried.

The inventors et al. of the present invention applies drying of the ink by the nano-size overheated dry vapor of the present invention to the full drying. As an example of the ink jet printer ink, used as a product code 4MDTY PCB ink of AGFA Materials Japan, Ltd.

Thus, the fixing characteristic of the silk ink was checked through: printing (applying) silk ink by the ink jet printer on a printed-circuit board as a substrate that has undergone pre-curing and post-curing; and changing the drying time by using the nano-size overheated dry vapor od 170° C. and the nano-size overheated dry vapor od 180° C. FIG. 16 shows the result. In the chart, "x" shows the case where the silk ink is exfoliated, "o" shows the case where the silk ink is not exfoliated, "Δ" shows the case where the silk ink is not exfoliated but there is an issue in the fixing characteristic.

As can be seen from FIG. 16, the ink drying method by using the nano-size overheated dry vapor according to the present invention can dry the direct plotter silk ink while maintaining the fixing characteristic.

Figure 17:
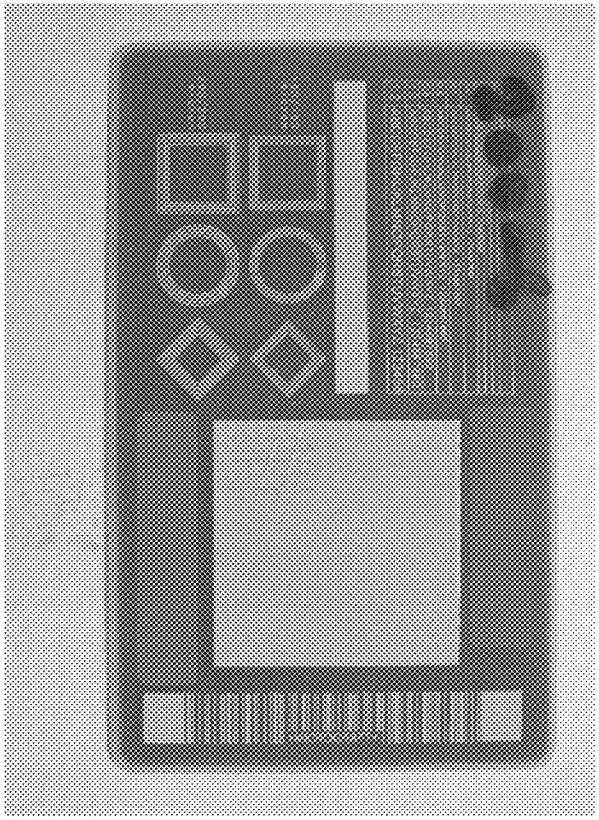
FIG. 17 is a view showing an external appearance in which direct plotter silk ink is dried by using an ink drying method using the nano-size overheated dry vapor according to the present invention.

FIG. 17 shows an external appearance of a case where the direct plotter silk ink is dried by using the ink drying method that uses the nano-size overheated dry vapor according to the present invention. From FIG. 17, it can also be seen that the ink drying method using the nano-size overheated dry vapor according to the present invention is optimum for fully drying the direct plotter silk ink.

As described, ink drying by the two stages of nano-sizing processing is excellent compared to the conventional method, and it is indirectly verified that ink drying by the three stages of nano-sizing processing has a greater energy than ink drying by the two stages of nano-sizing processing and it is excellent compared to the conventional method.

While the case of using the printed-circuit board as the substrate is described above, the substrate maybe any other substrates other than the printed-circuit board since the ink drying mechanism by the nano-size overheated dry vapor does not depend on the substrates as shown in FIG. 1. Moreover, whether the board surface of the substrate is of transmission type or non-transmission type is not an issue since the nano-size overheated dry vapor goes through the behaviors shown in FIG. 1 to dry the ink.

As described above, with the embodiment of the present invention, the overheated dry vapor is modified into the nano-size overheated dry vapor through executing at least the two stages of nano-sizing processing in which an injection energy is given to the overheated dry vapor for clustering it and a collision energy is given to the clustered nano-size overheated dry vapor for infusing the nano-size overheated dry vapor into the molecules and molecular interfaces of the ink. Therefore, ink applied on the substrate can be dried in a short time.

As the results of experiments, it is found that the ink on the printed-circuit board was able to be dried by infusing the nano-size overheated dry vapor on which nano-sizing processing was performed by being heated to 170° C. to 210° C. into the ink applied to the printed-circuit board used as the substrate in a thickness of about 20 μm for 3 minutes. Further in the experiments, the same result was acquired not only in the case of 170° C. but also in the cases where the temperature at which the saturated moisture vapor is dried is set to 180 to 210° C., for example.

Conventionally, a warm air of 150° C. is blown to the printed-circuit board over 60 to 90 minutes. However, with the embodiment of the present invention, the ink drying time can be shortened to 3 minutes at 170° C., for example. Therefore, not only the thermal stress given to the substrate such as the printed-circuit board can be lightened greatly but also the energy can be saved.

INDUSTRIAL APPLICABILITY

The ink drying method using the nano-size overheated dry vapor according to the present invention can be broadly applied for drying the ink used in the manufacturing steps of printed-circuit boards, direct plotter ink, and the like.

REFERENCE NUMERALS

1 Substrate
2 Ink
3 Nano-size overheated dry vapor
4 Overheated dry vapor generating module
5 Nano-sizing module
6 Chamber
7 Nano-size overheated dry vapor supplying module

The invention claimed is:

1. An ink drying method for drying ink applied to a substrate in which a moisture content is required to be approximately zero, the method comprising:

going through at least two stages of processing of giving an injection energy to overheated dry vapor acquired by drying saturated moisture vapor through applying heat for micronizing and clustering particles of the overheated dry vapor, and further micronizing the particles of the clustered overheated dry vapor to generate nano-size overheated dry vapor; and supplying the nano-size overheated dry vapor micronized and modified by going through the at least two stages of processing in a supersaturated state to a chamber in which the substrate is placed to form an anoxic atmosphere in the chamber, forcibly infusing the nano-size overheated dry vapor modified by going through the at least two stages of processing into molecular interfaces between molecules of the ink in the anoxic atmosphere to give the energy of the nano-size overheated dry vapor to molecular interfaces of the ink in order to evaporate moisture of the ink and to degrade or reduce an organic solvent existing in the ink interfaces, and infusing a part of the nano-size overheated dry vapor into an inside of the molecules of the ink by overpowering a surface tension of the molecules of the ink to give the energy of the nano-size overheated dry vapor to the molecules of the ink to cause evaporation of the moisture of the ink and degradation and reduction of the organic solvent existing inside the molecules of the ink, thereby drying the ink on the substrate whose moisture content is approximately zero.

2. The ink drying method as claimed in claim 1, comprising:

giving an excitation energy to the nano-size overheated dry vapor to which the collision energy has been given in order to achieve hyperfine micronization of the nano-size overheated dry vapor.

3. An ink drying device for drying ink applied to a substrate in which a moisture content is required to be approximately zero, comprising:

a nano-sizing module which performs at least two stages of processing of giving an injection energy to overheated dry vapor acquired by drying saturated moisture vapor through applying heat for micronizing and clustering particles of the overheated dry vapor, and further micronizing the particles of the clustered overheated dry vapor to generate nano-size overheated dry vapor;

a chamber to which the nano-size overheated dry vapor micronized and modified by going through the at least two stages of processing is supplied from the nano-sizing module in a supersaturated state to form an anoxic atmosphere for drying ink; and a nano-size overheated dry vapor supplying module which forcibly infuses the nano-size overheated dry vapor modified by going through the at least two stages of processing into molecular interfaces between molecules of the ink in the anoxic atmosphere to give the energy of the nano-size overheated dry vapor to molecular interfaces of the ink in order to evaporate moisture of the ink and to degrade or reduce an organic solvent existing in the ink interfaces, and infusing a part of the nano-size overheated dry vapor into an inside of the molecules of the ink by overpowering a surface tension of the molecules of the ink to give the energy of the nano-size overheated dry vapor to the molecules of the ink to cause evaporation of the moisture of the ink and degradation and reduction of the organic solvent existing inside the molecules of the ink, thereby drying the ink on the substrate whose moisture content is approximately zero.

4. The ink drying device as claimed in claim 3, wherein:

the nano-sizing module gives an excitation energy to the nano-size overheated dry vapor to which the collision energy has been given in order to achieve hyperfine micronization of the nano-size overheated dry vapor.

* * * * *